US006506722B1

(12) United States Patent
Bauer et al.

(10) Patent No.: US 6,506,722 B1
(45) Date of Patent: Jan. 14, 2003

(54) COGRANULATES COMPRISING ALKALI METAL PHYLLOSILICATES AND DISINTEGRANTS

(75) Inventors: Harald Bauer, Kerpen (DE); Josef Holz, Erftstadt (DE); Guenther Schimmel, Erftstadt (DE); Armelle Pelissou, Saint Ivery (FR)

(73) Assignee: Clariant GmbH, Frankfurt (DE)

( * ) Notice: Subject to any disclaimer, the term of this patent is extended or adjusted under 35 U.S.C. 154(b) by 153 days.

(21) Appl. No.: 09/659,386

(22) Filed: Sep. 11, 2000

(30) Foreign Application Priority Data

Sep. 11, 1999 (DE) ..... 199 43 237

(51) Int. Cl.[7] ..... C11D 3/08

(52) U.S. Cl. ..... 510/511; 510/276; 510/298; 510/302; 510/444; 510/445; 510/446; 510/334; 510/531

(58) Field of Search ..... 510/276, 298, 510/302, 444, 445, 446, 334, 511, 531

(56) References Cited

U.S. PATENT DOCUMENTS

| | | | | | |
|---|---|---|---|---|---|
| 4,664,839 | A | | 5/1987 | Rieck | 252/175 |
| 4,820,439 | A | | 4/1989 | Rieck | 252/135 |
| 5,356,607 | A | | 10/1994 | Just | 423/334 |
| 5,540,855 | A | * | 7/1996 | Baillely et al. | 510/276 |
| 5,614,161 | A | | 3/1997 | Wilkens et al. | 423/332 |
| 5,700,771 | A | * | 12/1997 | Hardy et al. | 510/315 |
| 5,900,399 | A | * | 5/1999 | Seiter et al. | 510/446 |
| 5,981,460 | A | * | 11/1999 | Dodd et al. | 510/329 |
| 6,099,595 | A | | 8/2000 | Holz et al. | 23/295 R |

FOREIGN PATENT DOCUMENTS

| | | |
|---|---|---|
| DE | 44 39 083 | 5/1996 |
| DE | 196 01 063 | 9/1996 |
| DE | 197 10 254 | 9/1998 |
| DE | 197 23 028 | 12/1998 |
| DE | 199 25 928 | 1/2000 |
| EP | 0 164 514 | 12/1985 |
| EP | 0 812 808 | 6/1997 |
| WO | WO 95/21908 | 8/1995 |
| WO | WO 91/08171 | 6/1997 |
| WO | WO 98/40462 | 9/1998 |
| WO | WO 98/40463 | 9/1998 |
| WO | WO 98/55583 | 12/1998 |

OTHER PUBLICATIONS

German Search Report
Derwent Patent Family Abstract for DE 44 39 083.
Derwent Patent Family Abstract for DE 197 10 254.
Derwent Patent Family Abstract for WO 98/40462.
Derwent Patent Family Abstract for WO 98/40463.
Derwent Patent Family Abstract for DE 199 25 928.
English translation for DE 199 25 928.

* cited by examiner

*Primary Examiner*—Charles Boyer
(74) *Attorney, Agent, or Firm*—Richard P. Silverman

(57) ABSTRACT

The invention relates to cogranulates comprising phyllosilicates and disintegrants, in particular cellulose, and to detergents and cleaners which comprise these cogranulates, preferably in tablet form.

20 Claims, No Drawings

COGRANULATES COMPRISING ALKALI METAL PHYLLOSILICATES AND DISINTEGRANTS

BACKGROUND OF THE INVENTION

The invention relates to cogranulates comprising alkali metal phyllosilicates and disintegrants and to the use thereof in detergents and cleaners in tablet form.

WO 95/21908 has already disclosed tablets for use in detergents and cleaners, which are obtained by compressing a mixture consisting essentially of phyllosilicates and organic disintegrants, such as, for example, cellulose or cellulose derivatives. Both components are in powder form.

WO 98/40462 describes compacts which comprise cellulosic material in granulate form, and WO 98/40463 describes tablets which comprise cellulose-containing granulates and other constituents. These other constituents, which also include crystalline and amorphous silicates, can likewise be in the form of a granulate, although in each case the cellulose-containing granulate is free from silicates.

SUMMARY OF THE INVENTION

We have now found that cogranulates comprising alkali metal phyllosilicates and a disintegrant can be used advantageously for the disintegration of tablets for detergents and cleaners.

The invention provides cogranulates comprising alkali metal phyllosilicates and disintegrants.

DESCRIPTION OF THE PREFERRED EMBODIMENTS

Preferred alkali metal phyllosilicates which can be used advantageously in the cogranulates according to the invention are those of the formula $NaMSi_xO_{2x+1}\cdot yH_2O$, where M is sodium or hydrogen, x is a number from 1.9 to 4, and y is a number from 0 to 20, and preferred values for x are 2, 3 or 4. Such phyllosilicates are described in EP-B-0 164 514, to which reference is expressly made here. Preferred phyllosilicates are those in which M is sodium, and x assumes the values 2 or 3. In particular, both beta- and delta-sodium disilicates $Na_2Si_2O_5\cdot yH_2O$ are preferred, it being possible to obtain beta-sodium disilicate, for example, by the process described in WO-A-91/08171. Beta-sodium disilicate is available commercially under the name SKS 7, and delta-sodium disilicate is available commercially under the name SKS 6 (commercial products from Clariant GmbH).

Further phyllosilicates which can be used preferentially for the cogranulate according to the invention are described in DE-A-198 30 591.5. This is a finely divided crystalline layered sodium disilicate of the formula $NaMSi_xO_{2x+1}\cdot yH_2O$, where M is sodium or hydrogen, x is a number from 1.9 to 4 and y is a number from 0 to 20, which is notable for the fact that it has a content of from 0 to 40% by weight of alpha-disodium silicate, 0 to 40% by weight of beta-disodium disilicate, 40 to 100% by weight of delta-dinatrium disilicate and 0 to 40% by weight of amorphous fractions, and a screen oversize residue of less than 60%, and is free from sodium metasilicate.

DE-A-196 01 063 describes a crystalline sodium phyllosilicate of the formula $xNa_2O*ySiO_2*zP_2O_5$ with an x:y ratio of from 0.35 to 0.6, an x:z ratio of from 1.75 to 1200 and a y:z ratio of from 4 to 2800. These phosphorus-containing phyllosilicates, which have a high degree of crystallinity and a very high calcium-binding capacity, are likewise preferably used for the cogranulate according to the invention.

Also used according to the invention are crystalline alkali metal phyllosilicates of the formula $a\ M^I_2O * b\ EO_2 * c\ X_2O_5 * d\ ZO_3\cdot SiO_2 * e\ H_2O$, in which $M^I$ is an alkali metal, E is an element from the fourth main group, X is an element from the fifth main group and Z is an element from the sixth main group of the Periodic Table of the Elements, and where the following apply:

$0 \leqq a \leqq 6.25$ $2.5\cdot 10^{-4} \leqq b \leqq 5.63$ $0 \leqq c \leqq 2.81$ $0 \leqq d \leqq 5.63$ $0 \leqq e \leqq 15.3$ In this connection, preferred crystalline alkali metal phyllosilicates are those which have a certain content of phosphorus, sulfur and/or carbon.

Suitable silicates are, however, also highly alkaline crystalline sodium silicates of the composition.

All following percentages refer to percentages by weight, unless otherwise stated.

$$Na_2O * x\ SiO_2 * y\ H_2O$$

where x is a number between 1.2 and 2.1, and y is a number between 0 and 20, and the highly alkaline crystalline sodium silicate consists of 70 to 98% by weight of layered disodium disilicates and 2 to 30% by weight of non-phyllosiliceous sodium silicates of the formula $$Na_2O*v\ SiO_2*w\ H_2O$$

in which v is a number between 0.05 and 2, and w is a number between 0 and 20.

Finally, preference is also given to using sparingly soluble alkali metal silicates which are notable for the fact that they comprise alkali metal phyllosilicates in finely dispersed form in a non-phyllosiliceous alkali metal silicate environment of the formula $x\ M^I_2O\cdot y\ SiO_2$, in which $M_1$ is an alkali metal and y/x is (1.9 to 500): 1. In this connection, the alkali metal silicate corresponds overall to the formula $$a\ M^I_2O\cdot b\ M^{II}O\cdot c\ X_2O_3\cdot d\ Z_2O_5\cdot e\ SiO_2\cdot f\ H_2O$$

in which $M^I$ is an alkali metal, $M^{II}$ is an alkaline earth metal, X is an element from the third main group and Z is an element from the fifth main group of the Periodic Table of the Elements and where the following apply:

$0 \leqq a \leqq 1;$ $0 \leqq b \leqq 0.5;$ $0 \leqq c/e \leqq 0.05;$ $0 \leqq d/e \leqq 0.25;$ $1.9 \leqq e \leqq 4;$ $0 \leqq ff \leqq 20$ Preference is given here to sparingly soluble alkali metal silicates which have a certain content of alkaline earth metal ions (magnesium and/or calcium), boron and/or phosphorus.

Suitable disintegrants are, in particular, starch and starch derivatives, cellulose and cellulose derivatives, for example microcrystalline cellulose, CMC MC, alginic acid and salts thereof, carboxymethylamylopectin, polyacrylic acid, polyvinylpyrrolidone and polyvinylpolypyrrolidone. Particular preference is given to the use of cellulose in the form of compacted pulp, such as TMP (thermomechanical pulp) or CTMP (chemothermomechanical pulp). Such products are available, for example, under the type designations Arbocel®-B and Arbocel®-BC (beechwood cellulose), Arbocel®-BE (beechwood sulfite cellulose), Arbocel®-B-SCH (cotton cellulose), Arbocel®-FIC (spruce cellulose) and other Arbocel® grades (Arbocel®-TF-30-HG) from Rettenmaier. Particular preference is given to those celluloses which have an average fiber length to diameter ratio of 16 to 1, preferably 10 to 4. Such products are available under the name Arbocel® TIC 200 and Arbocel® FDY 600 from Rettenmaier. Also preferred are microcrystalline celluloses, such as, for example, the Hewetten® grades (e.g. Heweften 200) and Vivapur grades (e.g. Vivapur 200).

The cogranulate preferably consists of 1 to 30% of disintegrants and 70 to 99% of alkali metal phyllosilicate. Particular preference is given to lower cellulose contents, especially between 5 and 19%. As further ingredients, the cogranulates can comprise between and 1 and 30% of granulation auxiliaries and phlegmatizers and also additional disintegration-promoting components.

Granulation auxiliaries and phlegmatizers are water, water glass, polyethylene glycol, nonionic surfactants, anionic surfactants, polycarboxylate copolymer, glycerol or ethylene glycol.

Disintegration-promoting components are readily soluble materials, generally alkali metal carbonates, alkali metal hydrogencarbonates, alkali metal silicates, alkali metal sulfates, alkali metal hydrogensulfates, alkali metal halides, alkali metal phosphates, alkali metal dihydrogenphosphates, alkali metal hydrogenphosphates, alkali metal borates, organic acids and salts thereof (citrates, acetates, formates, ascorbates etc.) or readily soluble organic compounds (e.g. urea). Readily soluble materials help to maintain or increase the porosity during the disintegration phase of the tablet. Preference is given to substances which form water of hydration, particular preference to those whose crystal lattice expands as a result of the incorporation of water of crystallization.

Swelling materials, such as, for example, smectites, polyvinylpyrrolidones, starches, can also be used as the disintegration-promoting component.

Suitable disintegration-promoting components are also substances which react with one another or with water with the evolution of gas. Preference is given here to combinations of solid acid and salt of an acid which is unstable (in water). Particular preference is given to soda and citric acid and sodium hydrogencarbonate and citric acid.

Likewise suitable for this purpose are also substances which liberate oxygen as a result of thermal, catalytic or enzymatic decomposition, e.g. inorganic and/or organic peroxides, and substances which react with water itself with the evolution of gas: e.g. peroxides, gas hydrates and salts which comprise occluded gases.

The cogranulate according to the invention preferably has a fines fraction of more than 2% by weight, particularly preferably more than 5% by weight, and preferably a 500 to 1500 $\mu$m fraction of more than 60% by weight and particularly preferably more than 70%.

The cogranulate according to the invention is prepared by firstly mixing phyllosilicates and disintegrants. If necessary, a granulation auxiliary or phlegmatizer can be added. The material is then compacted by compression granulation, and processed by grinding and screening.

The compression granulation is carried out by roll compaction, briquetting etc. In the case of roll compaction, a compaction pressure of from 1 kN/cm to 30 kN/cm is preferred and a compaction pressure of from 2 kN/cm to 20 kN/cm is particularly preferred.

For the grinding of the compacted raw material, ball mills, pendulum roller mills, roller mills, compressed-air mills, hammer mills and impact mills are suitable. If desired, grinding auxiliaries can be add ed.

The cogranulates according to the invention can be used in detergents and cleaners. Preference is given here to tablet-shaped heavy duty detergents, color detergents, specialty detergents and machine dishwashing detergents. Heavy duty detergents are balanced formulations with the aim of as high a detergency as possible. Color detergents are intended primarily to protect colored textiles with regard to bleaching and fading of the colors and matting of the fibers. Specialty detergents are aimed at narrow areas of application, such as stain-removal salts, curtain detergents, wool detergents and commercial laundry etc.

Machine dishwashing detergents serve for the domestic or commercial cleaning of crockery, cutlery etc.

The content of cogranulate in the detergents and cleaners can vary depending on the intended use. An effective cellulose amount of from 1 to 15%, particularly preferably from 4 to 10%, based on the total amount of detergent and cleaner, is preferred. This can be achieved by cogranulate amounts of from 3 to 95%, particularly preferably 13 to 70%.

Builder combinations are frequently used in detergents and cleaners. Preference is given here to 3 to 95% of phyllosilicate/disintegrant cogranulate and 0.5 to 70% of cobuilder. Cobuilders are crystalline aluminosilicates and/or monomeric carboxylic acids and salts thereof and/or oligomeric polycarboxylic acids and salts thereof and/or polymeric carboxylic acids and salts thereof and/or alkali metal carbonates and/or alkali metal hydrogencarbonates and/or crystalline alkali metal silicates having a crystal lattice without a layer structure and/or X-ray amorphous alkali metal silicates.

It is also possible to use phyllosilicates either in the cogranulate or also additionally separate therefrom. 3 to 95% of phyllosilicate/disintegrant cogranulate and 0.5 to 70% of additional phyllosilicate are likewise preferred. Particular preference is given to detergents and cleaners likewise comprising 3 to 95% of phyllosilicatelcellulose cogranulate and 0.5 to 70% of cobuilder and 0.5 to 70% of additional phyllosilicate.

Moreover, detergents and cleaners comprise a plurality of surfactants which can be nonionic, anionic, cationic or zwitterionic in nature. Of the nonionic surfactants, the alkyl ethoxylates are important. Surprisingly, it has been found that particularly those based on $C_{11}$-oxo alcohols and methyl ester ethoxylates have a favorable effect on tablet disintegration. In the case of the methyl ester ethoxylates, $C_{12-14}$-alkyl derivatives having 8 EO units and $C_{8-10}$-alkyl derivatives having 10 EO units are particularly preferred.

Preference is given to detergents and cleaners comprising 3 to 95% of phyllosilicate/disintegrant cogranulate and 0.5 to 60% of surfactant, in particular those formulations which comprise 3 to 95% of phylosilicate/cellulose cogranulate and 0.5 to 60% of surfactant and 0.5 to 70% of additional phyllosilicate.

In detergents and cleaners, bleaching-active substances serve to destroy and reduce germs and remove stains. Bleaching-active substances are, for example, perborates, percarbonates, persulfates, organic peroxides, enzymes, bleaching catalysts bas ed on heavy metals etc.

Preference is given to the following ratios: 3 to 95% of phyllosilicates/disintegrant cogranulate and 0.5 to 60% of bleaching-active substances; likewise preferred are the ratios: 3 to 95% of phyllosilicate/cellulose cogranulate and 0.5 to 60% of bleaching-active substances and 0.5 to 70% of additional phyllosilicate.

Detergents and cleaners of the following compositions are also preferred:

1) 3 to 95% of phyllosilicate/disintegrant cogranulate and 0.5 to 70% of cobuilder and 0.5 to 60% of surfactant;
2) 3 to 95% of phyllosilicate/disintegrant cogranulate and 0.5 to 70% of cobuilder and 0.5 to 60% of surfactant and 0.5 to 70% of phyllosilicate;
3) 3 to 95% of phyllosilicate/disintegrant cogranulate and 0.5 to 70% of cobuilder and 0.5 to 60% of bleaching-active substances;
4) 3 to 95% of phyllosilicate/disintegrant cogranulate and 0.5 to 70% of cobuilder, 0.5 to 60% bleaching-active substances and 0.5 to 70% of phyllosilicate;
5) 3 to 95% of phyllosilicate/disintegrant cogranulate and 0.5 to 70% of cobuilder and 0.5 to 60% of surfactant and 0.5 to 60% of bleaching-active substances;
6) 3 to 95% of phyllosilicate/disintegrant cogranulate and 0.5 to 70% of cobuilder and 0.5 to 60% of surfactant and 0.5 to 60% of bleaching-active substances and 0.5 to 70% of phyllosilicate.

It is also possible to color the cogranulate. Preferred concentration ranges are 50 to 99% of phyllosilicate/disintegrant cogranulate and 0.01 to 10% of dye/pigment. Suitable dyes may primarily be the Sandolan types (Sandolan Walkblau N-BL 150) or also Telon types (Telon Blau AFN, DyStar). Pigments such as Patentblau (DyStar) can also be used.

The detergents and cleaners which comprise the cogranulates according to the invention can be in the form of powders or tablets. For the tableting of the detergents, compaction pressures of from 0.08 to 3.8 kN/cm$^2$ are preferred, and of 0.5 to 2.3 kN/cm$^2$ are particularly preferred.

For the tableting of the machine dishwashing detergents, compaction pressures of from 0.7 to 14.2 kN/cm$^2$ are preferred and pressures of from 2.8 to 10 kN/cm$^2$ are particularly preferred.

The tablets can be cylindrical or cuboid, or else largely assume any desired geometric shapes. In the case of the cylinder, the radius to height ratio can be between 0.25 to 4. The compaction pressure can be between 12 and 0.3 kN/cm$^2$. Preference is also given to multistage compression. Here, any desired components of the formulation are compressed in a plurality of steps one after the other, resulting in a plurality of layers. In the case of two layers, a volume ratio of the two components of from 1 to 101to 10 to 1 is preferred. This also applies mutatis mutandis for more than two layers.

The invention also provides detergent and cleaning tablets which comprise 3 to 95% of phyllosilicate/disintegrant cogranulate and 0.5 to 70% of cobuilder.

Preference is also given to detergent and cleaner tablets which comprise 3 to 95% of phyllosilicate/disintegrant cogranulate, 0.5 to 70% of cobuilder and 0.5 to 70% of additional phyllosilicate.

Preference is also given to detergent and cleaning tablets which comprise 3 to 95% of phyllosilicate/disintegrant cogranulate, 0.5 to 70% of cobuilder and 0.5 to 70% of surfactant.

Preference is also given to detergent and cleaner tablets which comprise 3 to 95% of phyllosilicate/disintegrate cogranulate, 0.5 to 70% of cobuilder, 0.5 to 70% of surfactant and 0.5 to 70% of additional phyllosilicate.

Preference is also given to detergent and cleaner tablets which comprise 3 to 95% of phyllosilicate/disintegrant cogranulate, 0.5 to 70% of cobuilder, 0.5 to 70% of surfactant and 0.5 to 70% of bleaching-active substances.

Preference is also given to detergent and cleaner tablets which comprise 3 to 95% of phyllosilicate/disintegrant cogranulate, 0.5 to 70% of cobuilder, 0.5 to 70% of surfactant, 0.5 to 70% of bleaching-active substances and 0.5 to 70% of additional phyllosilicate.

Preference is also given to detergent and cleaner tablets which comprise 3 to 95% of phyllosilicate/disintegrant cogranulate, 0.5 to 70% of cobuilder and 0.5 to 70% of bleaching-active substances.

Preference is also given to detergent and cleaner tablets which comprise 3 to 95% of phyllosilicate/disintegrant cogranulate, 0.5 to 70% of cobuilder, 0.5 to 70% of bleaching-active substances and 0.5 to 70% of additional phyllosilicate.

Preference is also given to detergent and cleaner tablets which comprise 3 to 5% of phyllosilicate/disintegrant cogranulate and 0.5 to 70% of additional hyllosilicate.

Preference is also given to detergent and cleaner tablets which comprise 3 to 5% of phyllosilicate/disintegrant cogranulate and 0.5 to 70% of surfactant.

Preference is also given to detergent and cleaner tablets which comprise 3 to 95% of phyllosilicate/disintegrant cogranulate, 0.5 to 70% of surfactant and 0.5 to 70% of additional phyllosilicate.

Preference is also given to detergent and cleaner tablets which comprise 3 to 95% of phyllosilicate/disintegrant cogranulate and 0.5 to 70% of bleaching-active substances.

Preference is also given to detergent and cleaner tablets which comprise 3 to 95% of phyllosilicate/disintegrant cogranulate, 0.5 to 70% of bleaching-active substances and 0.5 to 70% of additional phyllosilicate.

Determination of the particle size distribution using a Microtrac granulometer The particle size in the dispersion is determined using an ASVR/FRA Microtrac granulometer from Leeds & Northrup. The parameter measured is the reflection or diffraction of a laser beam upon passing through the dispersion. 400 ml of ethanol are pumped through the laser measuring cell. The solid sample (e.g. 70 mg) is automatically metered in, and after 10 min the particle size distribution is determined. The evaluation unit of the instrument calculates the $d_{90}$ value.

Solubility Test

For this, 950 ml of tap water (water hardness 15 degrees of German hardness) are heat-treated at 30° C. in a 1 l beaker and stirred with a magnetic stirrer. The detergent tablet is placed into a metal screen insert (screen size 5 mm), which in turn is immersed into the liquid. The tablet is covered by the liquid by about 2 cm. The time taken for the tablet to fall through the screen is determined as the dissolution time in seconds using a laboratory stopwatch.

Roll Compaction

In a roll compactor (Hosokawa-Bepex, model: L200/50P), the starting material is conveyed between the compactor rollers using a stuffing screw (setting: stage 2 to 3). This is done at such a rate that a laying-on length of 50 mm produces the desired compaction pressure. The roller rotation is set at stage 2 and the nip is 0.1 mm. The resulting sticks (length: about 50 mm, thickness: about 2–5 mm, width about 10–15 mm) are crushed in a hammer mill (Alpine, model UPZ) with a perforation diameter of 5 mm at a rotary speed of from 600 to 1400 rpm.

Production of Particle Size Fractions

From the crushed roll-compacted product, the coarse fraction is firstly separated off on an electrovibratory screen (Siemens) with built-in 1 mm screen. From the material which passes through the screen, the undersize fraction is separated off using a second screen (500 ρm). The material which remains on the screen is the desired product.

Preparation of the Test Detergent, Procedure 1

Zeolite A/or commercially available SKS-6 powder, soda and PCA powder are thoroughly mixed in a domestic multimixer (Braun), and then the surfactants AE or MEE are sprayed on and mixed in. The other components (citric acid, hydrogencarbonate, LAS) are then mixed in. Finally, TAED, percarbonate, cellulose or phyllosilicate/cellulose cogranulate are carefully mixed in.

Preparation of the Test Detergent, Procedure 2

If required, optical brighteners are dissolved in the liquid surfactant components (AE or MEE). This solution is sprayed in a domestic multimixer (Braun) onto solid components which have been thoroughly mixed beforehand (zeolite A, phosphate, PCA, soda, hydrogencarbonate, sulfate). The other components (LAS, SAS, soap, antifoam, phosphonate, PVP, SRP, CMC) are then mixed in, Finally, TAED, perborate or percarbonate, enzymes, phyllosilicate/cellulose cogranulate are carefully mixed in.

Preparation of the Test Machine Dishwashing Detergents

The components phosphate, silicate, soda, sodium citrate and polymer were charged to a Lödige plowshare mixer and thoroughly mixed. The alkyl ethoxylate is then sprayed on. Finally, enzymes, perfume, percarbonate or perborate, TAED and phyllosilicate/cellulose cogranulate are mixed in.

Tableting of Detergents

For tableting, the premixed test detergent is pressed to the appropriate shape using a Matra tablet press. The compaction pressure can be between 3.8 and 0.08 kN/cm$^2$. The compact has a diameter of 41 mm and, depending on the initial weight, a height of, for example, 18 mm and a weight of, for example, 40g.

Tableting of Machine Dishwashing Detergents

For tableting, the premixed machine dishwashing detergent formulation is pressed to the appropriate shape using a Matra tableting press. The compaction pressure can be between 14.2 and 0.7 kN/cm$^2$. The compact has a diameter of 30 mm and, depending on the initial weight, a height of, for example, 20 mm and a weight of, for example, 25 g.

EXAMPLES

Example 1

A phyllosilicate was prepared as in EP-B-0 164 514 by spray-drying 150 kg of water glass having a percentage composition $Na_2O/SiO_2/H_2O$=15.5/30/54.5 (% by weight) in a laboratory spray drier (spray tower) from Anhydro to give an amorphous sodium silicate with an active substance content of 82.5%. 15 kg of the amorphous sodium silicate were heat-treated at 720° C. for 90 min in a muffle furnace (Nabertherm, model W1000/H). This was repeated a further four times. The cooled silicate powder (about 60 kg) was pulverized using a jaw crusher and a disk mill. 7.65 kg of the silicate powder were mixed with 1350 g of Arbocell® FIC 200 in a drum mixer. The mixture was compacted in accordance with the general procedures "Roll compaction" at a pressure of 60 kN and crushed to give a crude compact. 3 kg were processed in accordance with the general procedure "Production of particle size fractions" to give a particle size fraction of from 500 to 1000 $\mu$m.

Example 2

3kg of the crude compact from Example 1 were processed in accordance with the general procedure "Production of particle size fractions" to give a particle size fraction of from 500 to 710 $\mu$m.

Example 3

3 kg of the crude compact from Example 1 were processed in accordance with the general procedure "Production of particle size fractions" to give a particle size fraction of from 500 to 2360 $\mu$m.

Example 4

2.43 kg of the silicate powder from Example 1 were mixed with 570 g of Arbocel FIC 200 in a tumble mixer. The mixture is processed in accordance with the general procedures "Roll compaction" and at a pressure of 60 kN, and in accordance with the general procedure "Production of particle size fractions" to give a particle size fraction of from 500 to 1000 $\mu$m.

Example 5

2.1 kg of the silicate powder from Example 1 were mixed with 900 g of Arbocel FIC 200 in a tumble mixer. The mixture was processed in accordance with the general procedures "Roll compaction" at a pressure of 60 kN and in accordance with the general procedure "Production of particle size fractions" to give a particle size fraction of from 500 to 1000 $\mu$m.

Example 6

A phyllosilicate was prepared as in EP-A-0 731 058 by dissolving 1319 g of disodium hydrogenphosphate dihydrate in 60 kg of water glass having a percentage composition $Na_2O/SiO_2/H_2O$=15.3/29.7/55 (% by weight), and the solution was spray-dried in a laboratory spray drier (spray tower) from Anhydro to give an amorphous sodium silicate with an active substance content of 83%. 15 kg of the amorphous sodium silicate were heat-treated at 720° C. for 90 min in a muffle furnace (Narbertherm, model W1000/H). This was repeated once more. The cooled silicate powder (about 24 kg) was pulverized using a jaw crusher and a disk mill. 2.55 kg of the silicate powder were mixed with 450 g of Arbocell FIC 200 in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 $\mu$m.

Example 7

A sparingly soluble alkali metal silicate, as described on page 3, was prepared by spray drying 60 kg of water glass having a percentage composition $Na_2O/SiO_2/H_2O$=15.1/29.9/55 (% by weight) in a laboratory spray drier (spray tower) from Anhydro to give an amorphous sodium silicate having an active substance content of 83%.

15 kg of the amorphous sodium silicate were heat-treated at 720° C. for 90 min in a muffle furnace (Nabertherm, model W1000/H). This was repeated once more. The cooled silicate powder (about 24 kg) was pulverized with a jaw crusher and a disk mill. 2.55 kg of this silicate powder were mixed with 450 g of Arbocell FIC 200 in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 $\mu$m.

Example 8

A highly alkaline crystalline sodium silicate—as described on page 2/3—was prepared by spray drying 60 kg of water glass having a percentage composition $Na_2O/SiO_2/H_2O$=16.6/28.9/54.5 in a laboratory spray drier (spray tower) from Anhydro to give an amorphous sodium silicate having an active substance content of 83%. 15 kg of the amorphous sodium silicate were heat treated at 720° C. for 90 min in a muffle furnace (Nabertherm, model W1000/H).

This was repeated once more. The cooled silicate powder (about 24 kg) was pulverized using a jaw crusher and a disk mill. 2.55 kg of the silicate powder were mixed with 450 g of Arbocell FIC 200 in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 μm.

Example 9

A crystalline alkali metal phyllosilicate, as described on page 2, was prepared by dissolving 810 g of anhydrous sodium carbonate in 60 kg of water glass having a percentage composition $Na_2O/SiO_2/H_2O$=15.3/29.7/55. The solution was spray-dried in a laboratory spray drier (spray tower) from Anhydro to give an amorphous sodium silicate having an active substance content of 82%. 15 kg of the amorphous sodium silicate were heat-treated at 720° C. for 90 min in a muffle furnace (Nabertherm, model W1000/H). This was repeated once more. The cooled silicate powder (about 24 kg) was pulverized with a jaw crusher and a disk mill. 2.55 kg of the silicate powder were mixed with of Arbocell FIC 200 in a tumble mixer. The mixture was compacted in accordance with the general procedures "Roll compaction" at a pressure of 20 kN, and processed in accordance with the general procedure "Production of particle size fractions" to give a particle size fraction of from 500 to 1000 μm.

Example 10

2.55 kg of the silicate powder from Example 9 were mixed with 450 g of Arbocell FIC 200 in a tumble mixer. The mixture was compacted in accordance with the general procedures "Roll compaction" at a pressure of 60 kN, and processed in accordance with the general procedure "Production of particle size fractions" to give a particle size fraction of from 500 to 1000

Example 11

2.55 kg of the silicate powder from Example 9 were mixed with 450 g of Arbocell FIC 200 in a tumble mixer. The mixture was compacted in accordance with the general procedures "Roll compaction" at a pressure of 100 kN and processed in accordance with the general procedure "Production of particle size fractions" to give a particle size fraction of from 500 to 1000

Example 12

7 kg of a commercially available SKS-6 powder (alpha phase 15%, beta phase 10%, delta phase 75%) were ground for 50 min using a U 280A0 ball mill from Welte which is lined on the inside with metal and whose drum turns at about 50 rpm. The grinding media used were 44 kg of porcelain balls. This procedure was repeated with fresh SKS-6 powder, and the two fine powder batches were combined. The resulting fine powder gave the following analysis: $d_{90}$=48 μm (Microtrac) and the same phase distribution as in the starting material. 2.55 kg of this silicate powder were mixed with 450 g of Arbocell FIC 200 in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 μm.

Example 13

2.55 kg of the silicate powder from Example 12 were mixed with 450 g of Arbocell FDY 600 in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 μm.

Example 14

2.55 kg of the silicate powder from Example 12 were mixed with 450 g of Sokalan® HP50 in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 μm.

Example 15

2.1 kg of the silicate powder from Example 12 were mixed with 450 g of Arbocell FIC 200 and 450 g of sodium acetate trihydrate in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 μm.

Example 16

2.1 kg of the silicate powder from Example 12 were mixed with 450 g of Arbocell FIC 200 and 450 g of sodium citrate trihydrate in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 μm.

Example 17

2.1 kg of the silicate powder from Example 12 were mixed with 450 g of Arbocell FIC 200 and 450 g of citric acid in a tumble mixer. The mixture was compacted in accordance with the general procedures "Roll compaction" at a pressure of 60 kN, and processed in accordance with the general procedure "Production of particle size fractions" to give a particle size fraction of from 500 to 1000 μm.

The examples below describe a number of detergent formulations in compressed form. The composition of these detergent formulations is given in the tables below, which also give the dissolution time measured in accordance with the general procedure "Solubility test". The detergent formulations were prepared in accordance with the general procedure "Preparation of the test detergents, procedure 1" for Examples 18 to 48 and in accordance with the general procedure "Preparation of the test detergents, procedure 2" for Examples 49 to 56, and the general procedure "Tableting of detergents". Examples 57 to 62 were formulated in accordance with the general procedures "Preparation of the test machine dishwashing detergents" and "Tableting of machine dishwashing detergents". The compaction pressure was 10 kN, apart from for the formulations of Examples 34, 57, 58, 59, 60, 61 and 62, where the compaction pressure was 50 kN. In the case of Example 33, the compaction pressure was 5 kN.

TABLE 1

| Examples | | 18 | 19 | 20 | 21 | 22 | 23 |
|---|---|---|---|---|---|---|---|
| Zeolite A | [%] | 9.7 | 9.7 | — | 9.7 | 9.7 | 9.7 |
| SKS-6 | [%] | 28.3 | — | 20.7 | — | | 11 |
| Silicate Ex. 1 | [%] | — | 33.3 | 33.3 | 33.3 | — | — |
| Silicate Ex. 4 | [%] | — | — | — | — | 33.3 | — |
| Silicate Ex. 5 | [%] | — | — | — | — | — | 33.3 |
| FIC 200 | [%] | 5 | — | — | — | — | — |
| HCit | [%] | 5 | 5 | — | 5 | 5 | — |
| NaHC | [%] | 6 | 6 | — | 6 | 6 | |
| LAS | [%] | 7 | 7 | 7 | 7 | 7 | 7 |
| AE 1 | [%] | 4 | 4 | 4 | — | — | — |
| MEE 1 | [%] | — | — | — | 4 | 4 | 4 |
| Soda | [%] | 13 | 13 | 13 | 13 | 13 | 13 |
| PCA 1 | [%] | 4 | 4 | 4 | 4 | 4 | 4 |
| NaPC | [%] | 12 | 12 | 12 | 12 | 12 | 12 |
| TAED 1 | [%] | 5 | 5 | 5 | 5 | 5 | 5 |
| Sulfate | [%] | 1 | 1 | 1 | 1 | 1 | 1 |
| Dissolution time | [s] | 62 | 18 | 27 | 13 | 10 | 13 |

TABLE 2

| Examples | | 24 | 25 | 26 | 27 | 28 | 29 |
|---|---|---|---|---|---|---|---|
| Zeolite A | [%] | 9.7 | 9.7 | 9.7 | 9.7 | 9.7 | 9.7 |
| Silicate Ex. 6 | [%] | 33.3 | 33.3 | — | — | — | — |
| Silicate Ex. 7 | [%] | — | — | 33.3 | — | — | — |
| Silicate Ex. 8 | [%] | — | — | — | 33.3 | — | — |
| Silicate Ex. 10 | [%] | — | — | — | — | 33.3 | — |
| Silicate Ex. 12 | [%] | — | — | — | — | — | 33.3 |
| HCit | [%] | 5 | 5 | 5 | 5 | 5 | 5 |
| NaHC | [%] | 6 | 6 | 6 | 6 | 6 | 6 |
| LAS | [%] | 7 | 7 | 7 | 7 | 7 | 7 |
| AE 1 | [%] | — | 2 | — | — | — | — |
| MEE 1 | [%] | 4 | 2 | 4 | 4 | 4 | 4 |
| Soda | [%] | 13 | 13 | 13 | 13 | 13 | 13 |
| PCA 1 | [%] | 4 | 4 | 4 | 4 | 4 | 4 |
| NaPC | [%] | 12 | 12 | 12 | 12 | 12 | 12 |
| TAED 1 | [%] | 5 | 5 | 5 | 5 | 5 | 5 |
| Sulfate | [%] | 52.3 | 52.3 | 52.3 | 52.3 | 52.3 | 52.3 |
| Dissolution time | [s] | 13 | 18 | 12 | 14 | 12 | 13 |

TABLE 3

| | | Examples | | | | | | |
|---|---|---|---|---|---|---|---|---|
| | | 30 | 31 | 32 | 33 | 34 | 35 | 36 |
| Zeolite A | [%] | 9.7 | 9.7 | 9.7 | 9.7 | 9.7 | 9.7 | 9.7 |
| Silicate Ex. 9 | [%] | 33.3 | — | — | — | — | — | — |
| Silicate Ex. 10 | [%] | — | 33.3 | — | 33.3 | 33.3 | — | — |
| Silicate Ex. 11 | [%] | — | — | 33.3 | — | — | — | — |
| Silicate Ex. 2 | [%] | — | — | — | — | — | 33.3 | — |
| Silicate Ex. 3 | [%] | — | — | — | — | — | | 33.3 |
| HCit | [%] | 5 | 5 | 5 | 5 | 5 | 5 | 5 |
| NaHC | [%] | 6 | 6 | 6 | 6 | 6 | 6 | 6 |
| LAS | [%] | 7 | 7 | 7 | 7 | 7 | 7 | 7 |
| MEE 1 | [%] | 4 | 4 | 4 | 4 | 4 | 4 | 4 |
| Soda | [%] | 13 | 13 | 13 | 13 | 13 | 13 | 13 |
| PCA 1 | [%] | 4 | 4 | 4 | 4 | 4 | 4 | 4 |
| NaPC | [%] | 12 | 12 | 12 | 12 | 12 | 12 | 12 |
| TAED 1 | [%] | 5 | 5 | 5 | 5 | 5 | 5 | 5 |
| Sulfate | [%] | 45.3 | 45.3 | 45.3 | 45.3 | 45.3 | 35.3 | 45.3 |
| Dissolution time | [s] | 31 | 14 | 25 | 13 | 39 | 8 | 17 |

TABLE 4

| Examples | | 37 | 38 | 39 | 40 | 41 |
|---|---|---|---|---|---|---|
| Zeolite A | [%] | 9.7 | 9.7 | 9.7 | 9.7 | 9.7 |
| SKS-6 | [%] | | — | 5 | 5 | 5 |
| Silicate Ex. 13 | [%] | 33.3 | — | — | — | — |
| Silicate Ex. 14 | [%] | — | 33.3 | — | — | — |
| Silicate Ex. 15 | [%] | — | — | 33.3 | — | — |
| Silicate Ex. 16 | [%] | — | — | — | 33.3 | — |
| Silicate Ex. 17 | [%] | — | — | — | — | 33.3 |
| HCit | [%] | 5 | 5 | 2.7 | 2.7 | — |
| NaHC | [%] | 6 | 6 | 3.3 | 3.3 | 6 |
| LAS | [%] | 7 | 7 | 7 | 7 | 7 |
| MEE 1 | [%] | 4 | 4 | 4 | 4 | 4 |
| Soda | [%] | 13 | 13 | 13 | 13 | 13 |
| PCA 1 | [%] | 4 | 4 | 4 | 4 | 4 |
| NaPC | [%] | 12 | 12 | 12 | 12 | 12 |
| TAED 1 | [%] | 5 | 5 | 5 | 5 | 5 |
| Sulfate | [%] | 34.3 | 34.3 | 34.3 | 34.3 | 34.3 |
| Dissolution time | [s] | 19 | 23 | 12 | 13 | 12 |

TABLE 5

| | | Examples | | | | | | |
|---|---|---|---|---|---|---|---|---|
| | | 42 | 43 | 44 | 45 | 46 | 47 | 48 |
| Zeolite A | [%] | 9.7 | 9.7 | 9.7 | 9.7 | 9.7 | 9.7 | 9.7 |
| Silicate Ex. 1 | [%] | 33.3 | 33.3 | 33.3 | 33.3 | 33.3 | 33.3 | 33.3 |
| HCit | [%] | 5 | 5 | 5 | 5 | 5 | 5 | 5 |
| NaHC | [%] | 6 | 6 | 6 | 6 | 6 | 6 | 6 |
| LAS | [%] | — | 7 | 7 | 7 | 7 | 7 | 7 |
| SAS | [%] | 7 | — | — | — | — | — | — |
| AE 1 | [%] | 4 | — | — | — | — | — | — |
| AE 2 | [%] | — | 4 | — | — | — | — | — |
| AE 3 | [%] | — | — | 4 | — | — | — | — |
| AE 4 | [%] | — | — | — | 4 | — | — | — |
| MEE 2 | [%] | — | — | — | — | 4 | — | — |
| GA 1 | [%] | — | — | — | — | — | 4 | — |
| GA 2 | [%] | — | — | — | — | — | — | 4 |
| Soda | [%] | 13 | 13 | 13 | 13 | 13 | 13 | 13 |
| PCA 1 | [%] | 4 | 4 | 4 | 4 | 4 | 4 | 4 |
| NaPC | [%] | 12 | 12 | 12 | 12 | 12 | 12 | 12 |
| TAED 1 | [%] | 5 | 5 | 5 | 5 | 5 | 5 | 5 |
| Sulfate | [%] | 45.3 | 45.3 | 45.3 | 45.3 | 45.3 | 35.3 | 45.3 |
| Dissolution time | [s] | 17 | 19 | 12 | 18 | 14 | 23 | 22 |

TABLE 6

| | | Examples | | | | | | | |
|---|---|---|---|---|---|---|---|---|---|
| | | 49 | 50 | 51 | 52 | 53 | 54 | 55 | 56 |
| Zeolite A | [%] | 18.7 | 18.7 | 40 | 24.7 | 24.7 | 16 | — | — |
| Phosphate 1 | [%] | — | — | — | — | — | — | — | 25 |
| Silicate Ex. 1 | [%] | — | — | 34 | — | — | — | 9 | — |
| Silicate Ex. 10 | [%] | — | — | — | — | — | 40 | — | |
| Silicate Ex. 5 | [%] | 26.3 | 26.3 | — | 26.3 | 26.3 | — | — | 26.3 |
| PCA 1 | [%] | 5 | 7 | 7 | 5 | — | 3 | — | 2 |
| Soda | [%] | 12 | — | — | — | 5 | 50 | 34 | 13 |
| NaHC | [%] | — | 18 | 5 | — | — | — | — | — |
| NaPB mh | [%] | 18 | — | — | — | — | — | — | — |
| NaPC | [%] | | — | — | — | — | — | 21 | 14 |
| TAED 1 | [%] | 4 | — | — | — | — | | 7 | 2 |
| LAS | [%] | 8 | 8 | — | 10 | 30 | — | — | 12 |
| SAS | [%] | — | — | 4 | — | — | — | 5 | — |
| AE 1 | [%] | 4 | 4 | 2 | 15 | 4 | 4 | — | 4.4 |
| MEE | [%] | — | — | — | 10 | 3 | 13.9 | — | — |
| Soap | [%] | 1 | 1 | 2 | — | — | 13.1 | 1 | — |
| Antifoam | [%] | 1 | 1 | — | — | — | | — | — |
| Enzyme | [%] | 1 | 1.5 | — | 1.5 | 0.5 | 0.5 | — | — |
| Enzyme 3 | [%] | 0.5 | 1.5 | — | 1.5 | 0.5 | 0.5 | — | — |
| Opt. brightener | [%] | 0.5 | — | — | — | 0.5 | — | — | — |
| Phosphonate 1 | [%] | — | 0.2 | — | — | — | — | — | — |
| HCit | [%] | — | 2 | 5 | — | — | — | — | — |
| PVP | [%] | — | 1 | — | — | — | — | — | — |
| SRP | [%] | — | 0.8 | — | — | — | — | — | — |
| CMC | [%] | — | 1 | — | — | — | — | — | — |
| Sulfate | [%] | — | 0.8 | 5.0 | 6.0 | 5.5 | 4.2 | 21.7 | 1.1 |
| Sodium chloride | [%] | — | — | — | — | — | — | 1.7 | — |

TABLE 7

| | | Examples | | | | | |
|---|---|---|---|---|---|---|---|
| | | 57 | 58 | 59 | 60 | 61 | 62 |
| Phosphate 2 | [%] | — | — | 25 | 35 | 20 | 20 |
| Meta ph | [%] | — | — | — | — | 40 | 3 |
| Silicate Ex. 1 | [%] | — | 15 | — | — | — | 47 |
| Silicate Ex. 12 | [%] | — | — | — | — | 10 | — |
| Silicate Ex. 4 | [%] | 20 | — | 20 | 20 | — | — |
| Soda | [%] | 22.7 | 32.7 | 25 | 24.7 | 17.5 | 17 |
| Sodium hydroxide | [%] | — | — | — | — | 8 | 8 |
| HCit th | [%] | 30 | 25 | — | — | — | — |
| NaPC | [%] | 10 | 10 | — | — | — | — |
| NaPB mh | [%] | — | — | 10 | 10 | — | — |
| NaDCC | [%] | — | — | — | — | 1 | 4 |
| PCA 2 | [%] | 7.5 | 7.5 | 5 | 3.5 | — | — |
| TAED 2 | [%] | 5 | 5 | 2 | 2 | — | — |
| Enzyme 2 | [%] | 1 | 1 | 1.5 | 1 | — | — |
| Enzyme 3 | [%] | 2 | 2 | 25 | 2 | — | — |
| AE 4 | [%] | 1.5 | 1.5 | 1.5 | 1.5 | 3.5 | 1 |
| Perfume | [%] | 0.3 | 0.3 | 1.5 | 0.3 | — | — |
| Sulfate | [%] | — | — | 6 | — | — | — |

| | |
|---|---|
| AE 1: | $C_{14}/C_{15}$-oxo alcohol + 8 EO (e.g. Genapol ® OAA 080, Clariant GmbH) |
| AE 2: | $C_{14}/C_{15}$-oxo alcohol + 4 EO (e.g. Genapol OAA 040, Clariant GmbH) |
| AE 3: | $C_{11}$-oxo alcohol + 11 EO (Genapol UD 110, Clariant GmbH) |
| AE 4: | $C_{16}/C_{18}$-fatty alcohol + 20 EO (Genapol T 200, Clariant GmbH) |
| AE 5: | $C_{10}/C_{12}$ Ziegler alcohol + 4EO and 4 PO (Genapol 2822, Clariant GmbH) |
| Antifoam: | polysiloxane (ASP3, Wacker) |
| CMC: | carboxymethylcellulose (Tylose ® 2000, Clariant GmbH) |

-continued

| | |
|---|---|
| Enzyme 1: | Termamyl ® 60 T (Solvay Enzymes) |
| Enzyme 2: | Termamyl 120T (Solvay Enzymes) |
| Enzyme 3: | Savinase ® 6.0 TW (Solvay Enzymes) |
| FIC 200: | cellulose (Arbocell ® FIC 200, Rettenmaier) |
| GA 1: | glucamide (GA 4096, Clariant GmbH) |
| GA 2: | $C_{16}/C_{18}$-glucamide + PEG-5 cocamide (Clariant GmbH) |
| HCit: | citric acid |
| LAS: | linear alkylbenzenesulfonate (Marlon ® , Hüls) |
| MEE 1: | $C_8/C_{18}$-methyl ester ethoxylate (10 EO) |
| MEE 2: | $C_{12}/C_{14}$-methyl ester ethoxylate (8 EO) |
| Meta ph: | metasilicate pentahydrate |
| NaDCC: | sodium dichlorodiisocyanurate |
| NaHC: | sodium hydrogencarbonate |
| NaPC: | sodium percarbonate |
| NaPB mh: | perborate monohydrate |
| Optical brightener: | Tinopal ® CBS-X (Ciba) |
| PCA 1: | maleic acid/acrylic acid copolymer (Sokalan ® CP5, BASF) |
| PCA 2: | maleic acid/acrylic acid copolymer (Sokalan 45, BASF) |
| Phosphate 1: | Na tripolyphosphate (Thermphos NW) |
| Phosphate 2: | Na tripolyphosphate (Makrophos 1018) |
| PVP: | polyvinylpyrrolidone (Sokalan HP50, BASF) |
| SAS: | sec-alkanesulfonate (Hostapur SAS 93-G, Clariant GmbH) |
| Soap: | Liga basic soap HM11E |
| SRP: | oligomeric polyesters (soil release polymers, SRC 2, Clariant GmbH) |
| TAED 1: | TAED 4049 (Clariant GmbH) |
| TAED 2: | TAED 3873 (Clariant GmbH) |

We claim:

1. A cogranulate comprising alkali metal phyllosilicates in an amount of 70 to 99% by weight and one or more disintegrants in an amount of 1 to 30% by weight and wherein the disintegrants are selected from the group consisting of starch, starch derivatives, cellulose, cellulose derivatives, microcrystalline cellulose, and mixtures thereof.

2. The cogranulate as claimed in claim 1, which comprises 1 to 19% by weight of disintegrants.

3. The cogranulate as claimed in claim 1, wherein the cogranulate further comprises an additional component selected from the group consisting of granulation auxiliaries, phlegmatizers, disintegration-promoting components, and mixtures thereof.

4. The cogranulate as claimed in claim 3, wherein the cogranulate comprises 1 to 30% by weight of said additional component.

5. A process for the preparation of the cogranulate as claimed in claim 1, which comprises firstly mixing phyllosilicate and disintegrants, compacting the mixture by compression granulation, and processing it by grinding and screening.

6. A detergent or cleaner comprising the cogranulate as claimed in claim 1 in tablet form.

7. A detergent tablet which comprises 3 to 95% of the cogranulate of claim 1 and 0.5 to 75% of cobuilder.

8. A detergent tablet which comprises 3 to 95% of the cogranulate of claim 1, 0.5 to 70% of cobuilder and 0.5 to 70% of additional phyllosilicate.

9. A detergent tablet which comprises 3 to 95% of the cogranulate of claim 1, 0.5 to 70% of cobuilder and 0.5 to 70% of surfactant.

10. A detergent tablet which comprises 3 to 95% of the cogranulate of claim 1, 0.5 to 70% of cobuilder, 0.5 to 70% of surfactant and 0.5 to 70% of additional phyllosilicate.

11. A detergent tablet which comprises 3 to 95% of the cogranulate of claim 1, 0.5 to 70% of cobuilder, 0.5 to 70% of surfactant and 0.5 to 70% of bleaching-active substances.

12. A detergent tablet which comprises 3 to 95% of the cogranulate of claim 1, 0.5 to 70% of cobuilder, 0.5 to 70% of surfactant, 0.5 to 70% of bleaching-active substances and 0.5 to 70% of additional phyllosilicate.

13. A detergent tablet which comprises 3 to 95% of the cogranulate of claim 1, 0.5 to 70% of cobuilder and 0.5 to 70% of bleaching-active substances.

14. A detergent tablet which comprises 3 to 95% of the cogranulate of claim 1, 0.5 to 70% of cobuilder, 0.5 to 70% of bleaching-active substances and 0.5 to 70% of additional phyllosilicate.

15. A detergent tablet which comprises 3 to 95% of the cogranulate of claim 1 and 0.5 to 70% of additional phyllosilicate.

16. A detergent tablet which comprises 3 to 95% of the cogranulate of claim 1 and 0.5 to 70% of surfactant.

17. A detergent tablet which comprises 3 to 95% of the cogranulate of claim 1, 0.5 to 70% of surfactant and 0.5 to 70% of additional phyllosilicate.

18. A detergent tablet which comprises 3 to 95% of the cogranulate of claim 1 and 0.5 to 70% of bleaching-active substances.

19. A detergent tablet which comprises 3 to 95% of the cogranulate of claim 1, 0.5 to 70% of bleaching-active substances and 0.5 to 70% of additional phyllosilicate.

20. A detergent tablet comprising the cogranulate of claim 1, wherein the cogranulate comprises 1 to 19% by weight of disintegrants and 1 to 30% by weight of an additional component selected from the group consisting of granulation auxiliaries, phlegmatizers, disintegration-promoting components, and mixtures thereof.

* * * * *